US005957757A

United States Patent [19]

Berman

[11] Patent Number: 5,957,757

[45] Date of Patent: Sep. 28, 1999

[54] CONDITIONING CMP POLISHING PAD USING A HIGH PRESSURE FLUID

[75] Inventor: Michael J. Berman, West Linn, Oreg.

[73] Assignee: LSI Logic Corporation, Milpitas, Calif.

[21] Appl. No.: 08/960,969

[22] Filed: Oct. 30, 1997

[51] Int. Cl.[6] ..... B24B 1/00

[52] U.S. Cl. ..... 451/56; 451/443; 451/444

[58] Field of Search ..... 451/283, 285, 451/287, 289, 444, 443, 259, 56, 63, 60, 28; 216/88; 156/636.1, 345

[56] References Cited

U.S. PATENT DOCUMENTS

| | | | |
|---|---|---|---|
| 5,578,529 | 11/1996 | Mullins | 451/287 |
| 5,584,749 | 12/1996 | Mitsuhashi et al. | 451/285 |
| 5,611,943 | 3/1997 | Cadien et al. | 451/287 |
| 5,643,067 | 7/1997 | Katsuoka et al. | 451/287 |
| 5,651,725 | 7/1997 | Kikuta et al. | 451/287 |
| 5,664,990 | 9/1997 | Adams et al. | 451/60 |
| 5,665,656 | 9/1997 | Jairath | 451/285 |
| 5,702,563 | 12/1997 | Salugsugan et al. | 451/28 |
| 5,709,593 | 1/1998 | Guthrie et al. | 451/287 |
| 5,725,417 | 3/1998 | Robinson | 451/56 |
| 5,755,614 | 5/1998 | Adams et al. | 451/60 |
| 5,868,608 | 2/1999 | Allman et al. | 451/72 |

*Primary Examiner*—David A. Scherbel
*Assistant Examiner*—Derris Holt Banks

[57] ABSTRACT

The present invention advantageously provides a method for conditioning a polishing pad used for chemical mechanical polishing of a semiconductor wafer surface. The method involves directing a fluid at a relatively high pressure toward the surface of the pad, thereby roughening the surface of the pad and removing particles embedded in pores of the pad. This process provides for uniform conditioning across the surface of the pad and excludes the use of particles which might become disposed on the pad, unlike some other conventional conditioning methods. The exclusion of abrasive particles prevents scratching of wafers which may subsequently undergo CMP using the polishing pad. The conditioning fluid hereof may, among other things, be a typical CMP slurry or variation thereof, or may be deionized water.

14 Claims, 2 Drawing Sheets

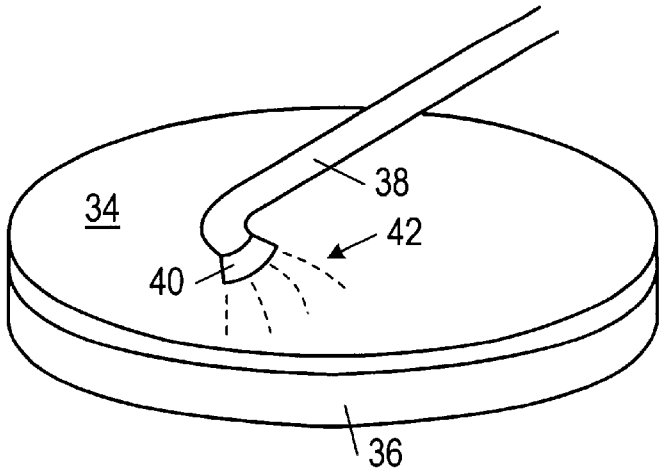
FIG. 3
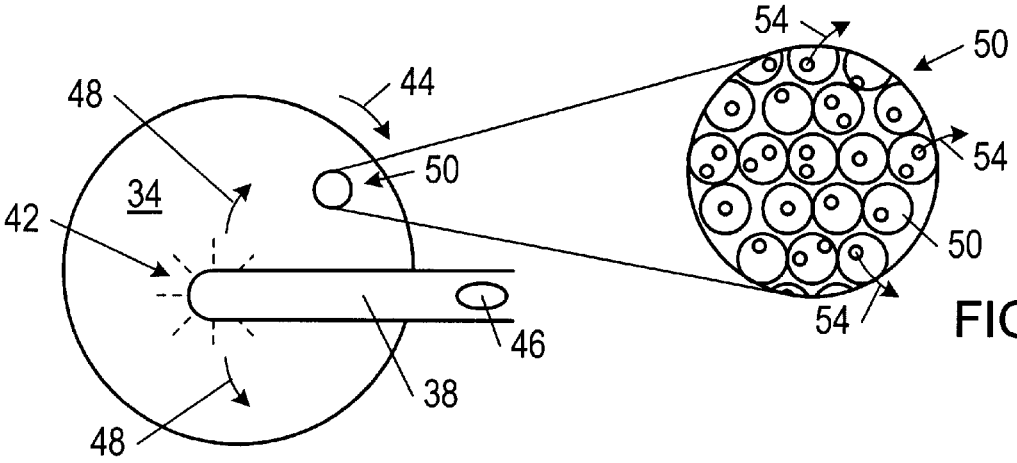
FIG. 4a
FIG. 4b

CONDITIONING CMP POLISHING PAD USING A HIGH PRESSURE FLUID

BACKGROUND OF THE INVENTION

1. Field of the Invention

This invention relates to integrated circuit manufacturing, and more particularly, to directing a fluid toward the surface of a CMP polishing pad at a relatively high pressure to condition the polishing pad.

2. Description of the Related Art

Fabrication of a multi-level integrated circuit involves numerous processing steps. After impurity regions have been deposited within a semiconductor substrate and gate areas defined upon the substrate, interconnect routing is placed on the semiconductor topography and connected to contact areas thereon. An interlevel dielectric is then formed upon and between the interconnect routing, and more contact areas are formed through the dielectric to the interconnect routing. A second level of interconnect routing may then be placed upon the interlevel dielectric and coupled to the first level of interconnect routing via the contact areas arranged within the dielectric. Additional levels of interconnect routing and interlevel dielectric may be formed if desired.

Unfortunately, unwanted surface irregularities may form in the topological surface of one or more layers employed by an integrated circuit. For example, a recess may result during the formation of conductive plugs which extend through an interlevel dielectric. Plug formation involves forming an opening through an interlevel dielectric and depositing a conductive material into that opening and across the interlevel dielectric. A recess may form in the upper surface of the conductive material since deposition occurs at the same rate upon the bottom of the opening as upon the sides of the opening. The formation of such recesses can lead to various problems during integrated circuit fabrication. For instance, when layers of material are formed across surfaces having recesses, step coverage problems may result. Step coverage is defined as a measure of how well a film conforms over an underlying step and is expressed by the ratio of the minimum thickness of a film as it crosses a step to the nominal thickness of the film on horizontal regions. In general, the height of the step, e.g., the depth of the recess, and the aspect ratio of the features being covered, e.g., the depth to width ratio of the recess, affect the step coverage. The greater the step height or the aspect ratio, the more difficult it is to achieve coverage of the step without a corresponding thinning of the film that overlies the step.

The concept of utilizing chemical and mechanical abrasion to planarize and remove surface irregularities of a topological surface is well known in industry as chemical-mechanical polishing ("CMP"). A typical CMP process involves placing a substrate, e.g., a semiconductor wafer face-down on a polishing pad which is fixedly attached to a rotatable table or platen. Elevationally extending portions of the downward-directed wafer surface are positioned such that they contact the rotating pad. A fluid-based chemical, often referred to as a "slurry" is deposited upon the pad possibly through a nozzle such that the slurry becomes disposed at the interface between the pad and the wafer surface. The slurry initiates the polishing process by chemically reacting with the surface material being polished. The polishing process is facilitated by the rotational movement of the pad relative to the wafer (or vice versa) to remove material catalyzed by the slurry. Thus, while the surface of the wafer is being polished, excess material is being removed from the wafer.

The polishing pad may be made of various substances. Typically, it is desirable to use a polishing pad which is both resilient and, to a lesser extent, conformal. The selection of pad weight, density, and hardness often depends on the material being polished. A popular polishing pad comprises polyurethane which, in most instances, does not include an overlying fabric material. An example of a somewhat hard polishing pad is the IC-1000 type pad commercially available from Rodel Products Corporation. A relatively soft pad is the SUBA 500 type pad, also manufactured by Rodel Products Corporation. Unfortunately, polishing pads used for wafer planarization may undergo a reduction in polishing rate and uniformity due to loss of sufficient surface roughness. Furthermore, the pores of polishing pads may become embedded with depleted slurry particles or polishing by-product. If the pores remain blocked over a substantial period of time, a condition known as "glazing" occurs. Glazing results when enough particles build-up on the polishing pad surface that the wafer surface begins to hydroplane over the surface of the pad. Hydroplaning eventually leads to substantially lower removal rates in the glazed areas.

A method known as pad conditioning is generally used to counter smoothing or glazing of the polishing pad surface and to achieve a relatively high and stable polishing rate. Pad conditioning is herein defined as a technique used to maintain the polishing pad surface in a state which enables proper polishing of a topological surface. Pad conditioning is typically performed by mechanically abraiding the pad surface in order to renew that surface. Such mechanical abrasion of the pad surface may roughen the surface and remove particles which are embedded in the pores of the polishing pad. Opening the pores permits the entrance of slurry into the pores during CMP to enhance polishing. Additionally, the open pores provide more surface area for polishing.

An example in which a polishing pad is conditioned concurrent with wafer polishing is shown in FIG. 1. FIG. 1 provides a perspective view of a polishing pad 10 mounted on a rotatable platen 12. Platen 12 rotates about a central axis 14 along the direction shown by arrow 16. Platen 12, including pad 10, can be directed upward against wafer 18 (or vice versa). Wafer 18 is secured in a rotatable position about axis 20 by an arm 22. Wafer 18 is mounted such that the frontside surface extends against pad 10, the frontside surface embodying numerous topological features used in producing an integrated circuit. Wafer 18 rotates about axis 20 along arrow 24 within a plane parallel to the plane formed by the polishing surface of pad 10.

Wafer 18 occupies a portion of the polishing surface, denoted as a circular track 26 defined by the rotational movement of pad 10. Track 26 is conditioned during wafer polish by a conditioning head 28. Conditioning head 28 is mounted on a movable arm 30 which can swing in position along track 26 commensurate with arm 22. Arm 30 presses an abrasive surface of conditioning head 28 against the polishing surface of pad 10 predominantly within track 26 as pad 10 rotates about axis 14. During this process, protrusions on the abrasive, downward-facing surface of head 28 extend toward the surface of polishing pad 10. Particles embedded in the pores of pad 10 are thus removed from the pad and flushed with slurry across the pad surface. As the slurry is introduced, the removed particles are rinsed over the edges of the polishing pad into a drain (not shown). Removing the particles from the polishing pad enables the depleted pad surface to be recharged with new slurry. The abrasive surface of conditioning head 28 may also function to roughen the surface of pad 10. FIG. 1 illustrates conditioning concurrent with wafer polishing; however, it is recognized that conventional conditioning can occur either before or after wafer polishing.

FIG. 2 depicts a cross-sectional view of the CMP and conditioning process illustrated in FIG. 1. More specifically, FIG. 2 illustrates the abrasive surface 32 formed at the lower surface of conditioning head 28. Abrasive surface 32 extends as a plurality of protrusions interspersed with recesses. The protrusions and recesses can be spaced close together or farther apart depending on the porosity of pad 10. Surface 32 preferably contacts the surface of pad 10 commensurate with wafer 18. More particularly, abrasive surface 32 extends below the upper surface of slurry film 34 to dislodge depleted slurry particles and/or wafer polish by-product from pores of pad 10. A problem associated with using such an abrasive surface 32 to condition pad 10 is that portions of the pad itself may be worn away. Frequent contact between surface 32 and pad 10 may lead to a significant reduction in the amount of pad material available for polishing. As such, the life of the pad may be reduced, resulting in additional costs for replacing the pad.

Another pad conditioning technique relates to pressing a disk covered with diamond particles against the polishing pad while rotating both the pad and the disk. The diamond particle covered disk typically has a large diameter which may lead to problems during pad conditioning. For instance, the surface of the disk may be non-planar across its entire surface. Thus, due to variations across the polishing pad as a result of CMP, the disk may gouge portions of the polishing pad while insufficiently conditioning other portions of the pad. Yet further, diamond particles may separate away from the disk during CMP and become lodged in the pores of the polishing pad. Dislodged diamond particles could scratch the surface of semiconductor wafers while they are being polished. Since the features of integrated circuits are so minute, even the tiniest scratch may render devices of the integrated circuit inoperable or may destroy interconnections between various devices.

It would therefore be desirable to develop a CMP pad conditioning process which has less adverse effects on the CMP process. A conditioning process is needed which would result in less wear on the polishing pad, and would thus lead to the pad having a longer life. It is also desirable for pad conditioning to be performed uniformly across the entire pad surface. Uniform conditioning of the pad would promote uniform polishing of a semiconductor topography, and thereby enhance the CMP process. Moreover, a conditioning process in which pad abrasion is achieved without using particles that may break off and become embedded in the pad is necessary. As a result, damaging the surface of a semiconductor topography during CMP would be less of a possibility.

SUMMARY OF THE INVENTION

The problems outlined above are in large part solved by the CMP pad conditioning technique hereof. The present invention advantageously provides a method for uniformly conditioning a CMP polishing pad across its entire surface. Conditioning of the pad is accomplished by directing a fluid at a relatively high pressure toward the surface of the polishing pad. The force of the fluid against the pad washes away particles that may have become embedded in the pores of the polishing pad. Contact between the fluid and the pad also roughens the surface of the pad. Conditioning of the pad in this manner may be performed subsequent to CMP polishing of the topological surface of a partially formed integrated circuit. The conditioning process may renew the pad to its original state such that the desired CMP polishing rate is still attainable.

In an embodiment, the polishing pad is positioned upon a rotatable table or platen in preparation for the conditioning process. The end of a conduit may be positioned directly above a region of the pad between a center of the pad and a lateral edge (periphery) of the pad. The conditioning fluid is passed out of the conduit while the pad is being rotated. The rate of rotation of the pad is preferably maintained relatively constant, resulting in the fluid contacting the various regions of the pad surface for equal lengths of time. As a result, conditioning uniformity may be achieved across the entire surface of the pad. Alternately, the conduit may be moved in a horizontal plane above the pad while the pad is stationary. That is, one end of the conduit is moved while the other end pivots about a central point. The moving end may travel in a path above a diameter of the pad as fluid exits the conduit from the moving end.

The fluid may be pumped through the conduit at such a force that the fluid applies a pressure ranging from about 75 psig to over 2,000 psig on the pad surface. The specific pressure used for the conditioning process is dependent on the hardness of the pad. The harder the polishing pad, the higher the pressure required to sufficiently condition the polishing pad. The pressure applied by the fluid, however, is maintained below an amount that could lead to wearing away of portions of a particular kind of pad. The conditioning fluid may be, for example, the slurry used during CMP. This CMP slurry may be diluted with deionized water, and a basic solution may be added to the diluted CMP slurry to adjust its pH. Contact between the particles in the slurry and the pad may advantageously aid in roughening of the pad surface. Since the slurry is directed toward the pad at such a high pressure, it is immediately washed away from the pad and does not clog pores of the pad. The use of a high pressure fluid is also beneficial in that the fluid removes particles from the pad that could scratch and damage the surface of a semiconductor wafer in ensuing CMP processing.

BRIEF DESCRIPTION OF THE DRAWINGS

Other objects and advantages of the invention will become apparent upon reading the following detailed description and upon reference to the accompanying drawings in which:

FIG. 3 is a perspective view of a CMP polishing pad being conditioned, according to an embodiment of the present invention;

FIG. 4*a* is a top plan view of the polishing pad as it is being conditioned; and FIG. 4*b* is a detailed view along section 50 of FIG. 4*a* which shows particles embedded in the pores of the polishing pad prior to conditioning thereof.

Figure 1:
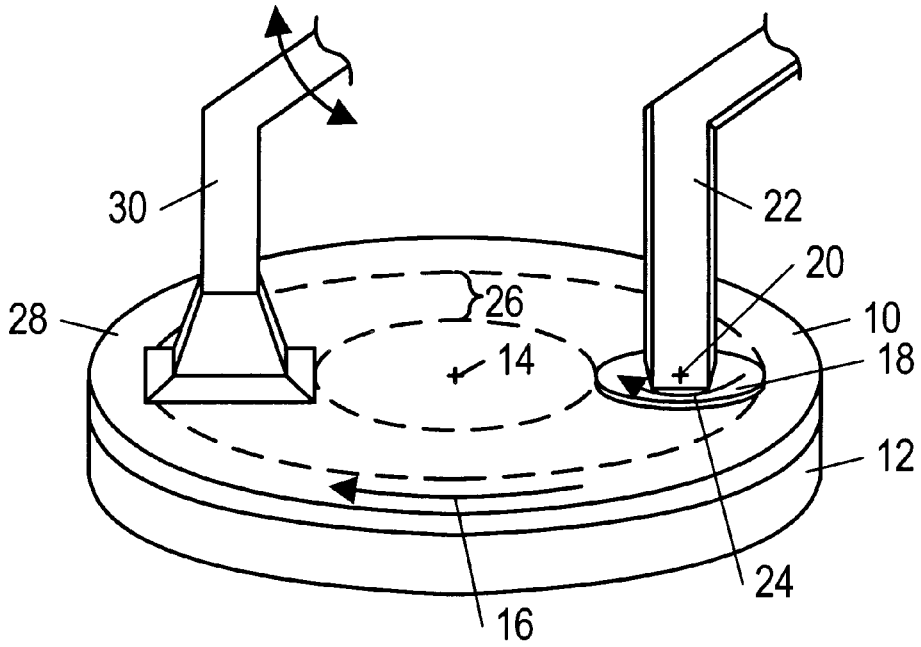
FIG. 1 (PRIOR ART)
FIG. 1 is a perspective view of a CMP system employing a conditioning head offset from a semiconductor wafer being polished according to a conventional technique.
Figure 2:
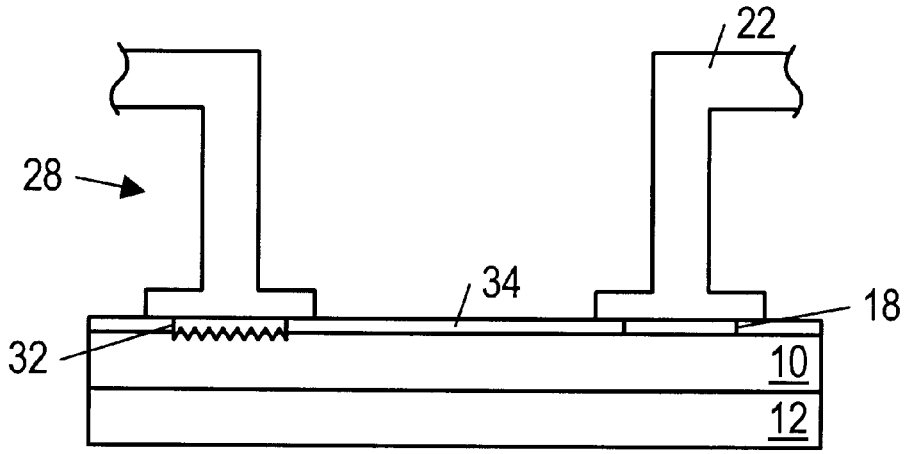
FIG. 2 (PRIOR ART)
FIG. 2 is a cross-sectional view of the CMP system shown in FIG. 1.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION OF THE INVENTION

Turning to FIG. 3, a CMP polishing pad 34 is positioned upon a rotatable table 36. A conduit 38 is positioned in a horizontal plane above polishing pad 34. A conditioning fluid 42 may be pumped through conduit 38 and out through a nozzle 40 attached to one end of conduit 38. Fluid 42 is directed toward the surface of pad 34 at a pressure sufficient to condition the polishing pad.

FIG. 4*a* illustrates the pad conditioning process in more detail. In one embodiment, conduit 38 is maintained in a stationary position above pad 34 while the pad is rotated in a clockwise or counterclockwise direction, as illustrated by arrow 44. The end from which fluid 42 exits from conduit 38 may be positioned directly above a region of the pad between its center and its edge. The rotatable table under pad 34 is rotated at a relatively constant rate, resulting in the rate of rotation of pad 34 being constant. Thus, as fluid 42 is sprayed from nozzle 40, it contacts the various regions of pad 34 for relatively equal amounts of time. Alternately, pad 34 may be maintained in an immobile position while conduit 38 is pivoted about a point 46. Movement of the conduit may require attachment of the conduit to a robotic arm. As conduit 38 is pivoted about point 46, the exiting end of the conduit is moved back and forth above the diameter of pad 34 in a path shown by arrows 48. In this manner, fluid 42 is sprayed toward various regions of pad 34 to condition the pad.

The pressure applied by fluid 42 to the surface of pad 34 is controlled to provide sufficient conditioning at the point where the fluid impinges upon the pad. The pressure applied to the pad may range from approximately 75 psig to over 2,000 psig, based on the type of pad being conditioned. For relatively soft pads, such as the SUBA 500 type pad, the fluid is preferably directed toward the polishing pad at a pressure between about 75 and 250 psig. The pressure applied by the fluid is preferably between about 500–1,500 psig for relatively hard pads, such as the IC-1000 type pad. FIG. 4*b* depicts a detailed view along section 56 of the surface of pad 34. The pores 50 of pad 34 are shown as having particles embedded in them. Such particles could be by-products of the CMP process. The particles may have belonged to the CMP slurry or to a layer of a semiconductor topography which had been polished. The high pressure fluid 42 directed toward the surface of pad 34 forces particles 56 out of pores 50 and away from the pad, as shown by arrows 54. As a result, the pores are no longer blocked by particles which may have later lead to inadequate CMP processing (e.g., "glazing"). High pressure fluid 42 is also directed toward pad 34 to roughen the surface of the pad. The pressure of fluid 42 against the pad surface is preferably maintained below an amount at which portions of the pad material itself are dislodged, torn, or removed.

A slurry similar to the kind used during CMP processing may be used as the conditioning fluid. Such a slurry is typically made of numerous chemical species, depending on the material being removed by CMP from a wafer surface. For example, a CMP slurry can comprise silica, alumina or ceria particles entrained within, e.g., a potassium or KOH-based solvent. The amount of particulate in the solvent can be selected and sold under various trade names, a suitable source being Semi-Spurse® or Cab-O-Sperse®, manufactured by Cabot, Inc. Merely as an example, a slurry composition which may be used for CMP of a tungsten film is a solution comprising suspended alumina and approximately 5–10% by weight of an oxidizer (e.g., potassium iodate, ferric nitrate, or hydrogen peroxide). For use as a conditioning fluid, the CMP slurry may be diluted with deionized water. A 0.5 to 2% by weight solution of, e.g., potassium hydroxide or ammonium hydroxide may be added to the diluted slurry to adjust its pH back to its pre-diluted value of approximately 10 to 11.

It will be appreciated to those skilled in the art having the benefit of this disclosure that this invention is believed to provide a method of directing a high pressure fluid toward a CMP polishing pad for the purpose of conditioning the pad and/or removing unwanted particles from the pad between or possibly during CMP processes. It is intended that the following claims be interpreted to embrace all such modifications and changes and, accordingly, the specification and drawings are to be regarded in an illustrative rather than a restrictive sense.

What is claimed is:

1. A method for conditioning a polishing pad, comprising:

polishing a semiconductor topography with a polishing surface of the polishing pad and an amount of a chemical mechanical polishing slurry;

diluting another amount of said chemical mechanical polishing slurry;

adjusting the pH of the diluted chemical mechanical polishing slurry back to its prediluted value to create a conditioning fluid;

arranging a conduit a spaced distance above the polishing surface; and forwarding said conditioning fluid through the conduit and upon the polishing surface at a pressure sufficient to dislodge particles entrained within pores of the polishing surface resulting from said polishing.

2. The method of claim 1, wherein said polishing comprises chemical mechanical polishing performed prior to arranging the conduit and forwarding the fluid.

3. The method of claim 1, wherein said pressure ranges from about 75 psig to over 2,000 psig.

4. The method of claim 1, further comprising positioning said polishing pad on a rotating device such that the polishing surface faces upward, and thereby rotating said polishing pad concurrent with the step of forwarding said fluid.

5. The method of claim 1, wherein the step of forwarding said fluid comprises pumping said fluid out through an end of said conduit, said end being disposed above said polishing surface.

6. The method of claim 1, further comprising maintaining said conduit in a substantially immobile position above said polishing surface and rotating said polishing pad concurrent with the step of directing said fluid such that said fluid contacts various regions of said polishing surface.

7. The method of claim 1, further comprising moving said conduit across a horizontal plane above said polishing surface concurrent with the step of forwarding said fluid such that said fluid contacts various regions of said polishing surface.

8. The method of claim 6 or 7, wherein said fluid is forwarded toward said polishing surface via a nozzle attached to said conduit.

9. The method of claim 1, wherein said chemical mechanical polishing slurry comprises particles selected from the group consisting of silica, alumina, and ceria.

10. The method of claim 1, wherein said pressure is sufficient to force particles from pores of said polishing surface and away from said polishing surface.

11. The method of claim 1, wherein said diluting comprises diluting said another amount of said chemical mechanical polishing slurry with deionized water.

12. The method of claim 1, wherein said prediluted pH value ranges from approximately 10 to 11.

13. The method as recited in claim 1, wherein said adjusting comprises adding potassium hydroxide or ammonium hydroxide to the diluted slurry.

14. The method as recited in claim 1, wherein said adjusting comprises adding a 0.5 to 2% by weight solution of potassium hydroxide or ammonium hydroxide to the diluted slurry.

* * * * *